US008757969B2

(12) United States Patent
Pruthi et al.

(10) Patent No.: US 8,757,969 B2
(45) Date of Patent: Jun. 24, 2014

(54) TURBINE EXHAUST PLENUM

(75) Inventors: Rohit Pruthi, Bangalore (IN); Deepesh D. Nanda, Bangalore (IN)

(73) Assignee: General Electric Company, Schenectady, NY (US)

( * ) Notice: Subject to any disclaimer, the term of this patent is extended or adjusted under 35 U.S.C. 154(b) by 890 days.

(21) Appl. No.: 12/883,158

(22) Filed: Sep. 15, 2010

(65) Prior Publication Data

US 2012/0063893 A1 Mar. 15, 2012

(51) Int. Cl.
*F01D 25/24* (2006.01)
*F01D 25/30* (2006.01)

(52) U.S. Cl.
USPC ..... 415/207; 415/212.1; 415/224; 60/697

(58) Field of Classification Search
USPC ..... 415/207, 212.1, 224–226; 60/697
See application file for complete search history.

(56) References Cited

U.S. PATENT DOCUMENTS 2,840,342 A * 6/1958 Silvern ..... 60/697
3,382,670 A 5/1968 Venable
4,013,378 A 3/1977 Herzog
4,326,832 A 4/1982 Ikeda et al.
5,203,674 A 4/1993 Vinciguerra
5,257,906 A 11/1993 Gray et al.
5,473,897 A * 12/1995 Elvekjaer ..... 60/612
5,603,605 A 2/1997 Fonda-Bonardi
6,419,448 B1 7/2002 Owczarek
8,418,717 B2 4/2013 Pruthi et al.
2010/0158683 A1* 6/2010 Macfarlane et al. ..... 415/207

FOREIGN PATENT DOCUMENTS

GB 2440343 A * 1/2008

OTHER PUBLICATIONS

U.S. Appl. No. 12/416,034, filed Mar. 31, 2009, Laxmikant Merchant.

* cited by examiner

*Primary Examiner* — Ned Landrum
*Assistant Examiner* — Justin Seabe
(74) *Attorney, Agent, or Firm* — Fletcher Yoder, P.C.

(57) ABSTRACT

In accordance with one embodiment, a system includes a turbine engine including an axial-radial diffuser section disposed about a first longitudinal axis downstream in an exhaust flow path from a turbine section. The system also includes an exhaust plenum including a first plenum portion disposed about the axial-radial diffuser section, wherein the first plenum portion includes a curved wall portion that diverges away from a circumference of the axial-radial diffuser section. The exhaust plenum also includes a second plenum portion extending away from the first plenum portion downstream along a second longitudinal axis of the exhaust plenum approximately crosswise to the first longitudinal axis.

9 Claims, 5 Drawing Sheets

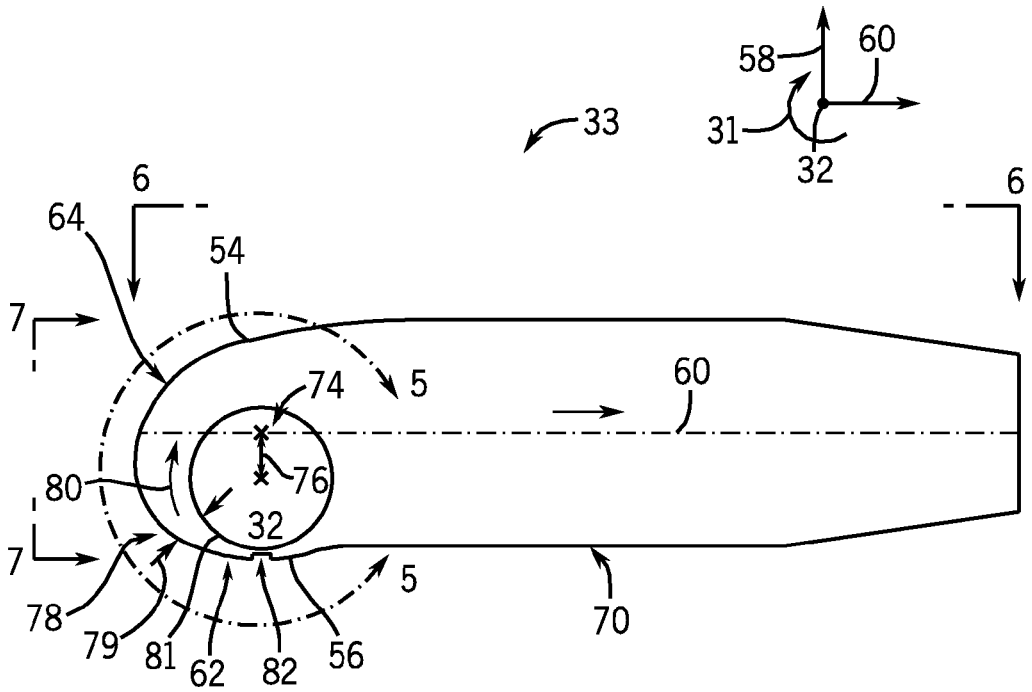
FIG. 4
FIG. 5
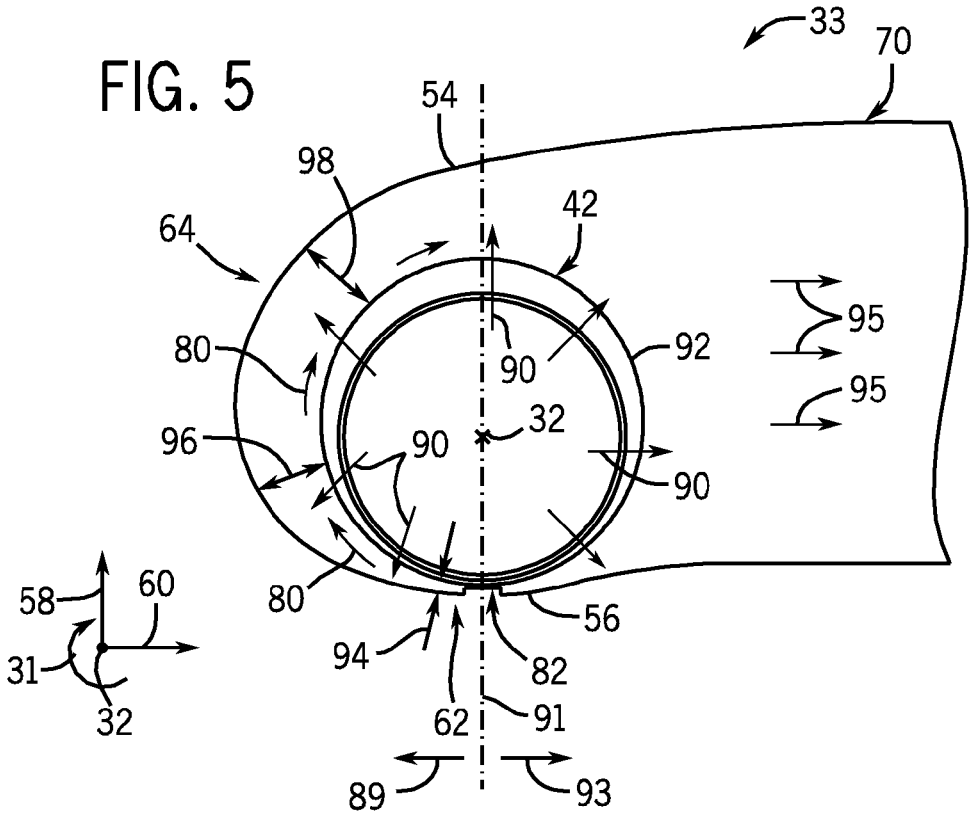

TURBINE EXHAUST PLENUM

BACKGROUND OF THE INVENTION

The subject matter disclosed herein relates to gas turbines, and more specifically, to exhaust systems for gas turbine engines.

A gas turbine engine combusts a mixture of compressed air and fuel to produce hot combustion gases. The combustion gases flow through one or more stages of turbine blades to generate power for a load and/or a compressor. The gas turbine engine delivers the combustion gases into an exhaust system, which reduces energy of the combustion gases prior to release into to the atmosphere. Unfortunately, existing exhaust systems include abrupt turns and expansions due to size constraints, turbine design constraints, and other factors. As a result, existing exhaust systems may create significant backpressure and flow separation, thereby reducing the performance of the gas turbine engine.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In accordance with a first embodiment, a system includes a turbine engine including an axial-radial diffuser section disposed about a first longitudinal axis downstream in an exhaust flow path from a turbine section. The system also includes an exhaust plenum including a first plenum portion disposed about the axial-radial diffuser section, wherein the first plenum portion includes a curved wall portion that diverges away from a circumference of the axial-radial diffuser section. The exhaust plenum also includes a second plenum portion extending away from the first plenum portion downstream along a second longitudinal axis of the exhaust plenum approximately crosswise to the first longitudinal axis.

In accordance with a second embodiment, a system includes a turbine exhaust plenum. The turbine exhaust plenum includes a first plenum portion including an axial-radial diffuser receptacle having a first axis approximately crosswise to a second axis extending lengthwise along the turbine exhaust plenum, wherein the first plenum portion includes a curved wall portion that diverges away from the first axis along a curved path in a first direction approximately crosswise to the first and second axes. The first plenum portion also includes first and second wall portions offset from one another along the first axis and the first and second wall portion diverge from one another in the first direction. The turbine exhaust plenum also includes a second plenum portion extending away from the first plenum portion downstream along the second axis of the exhaust plenum.

In accordance with a third embodiment, a system includes a turbine exhaust plenum. The turbine exhaust plenum includes a first plenum portion including an axial-radial diffuser receptacle having a first axis approximately crosswise to a second axis extending lengthwise along the turbine exhaust plenum. The first plenum portion also includes a curved wall portion that diverges away from the first axis along a curved path in a first direction approximately crosswise to the first and second axes. The turbine exhaust plenum also includes a second plenum portion extending away from the first plenum portion in a second direction along the second axis of the exhaust plenum, wherein the second plenum portion includes first and second wall portions offset from one another, and the first and second wall portions diverge from one another in the first direction or the second direction.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein:

FIG. 4 is a cross-sectional side view of an embodiment of the exhaust plenum, as shown in FIG. 1, illustrating a curved wall portion;

FIG. 5 is a partial cross-sectional side view of the exhaust plenum in FIG. 4;

DETAILED DESCRIPTION OF THE INVENTION

Figure 1:
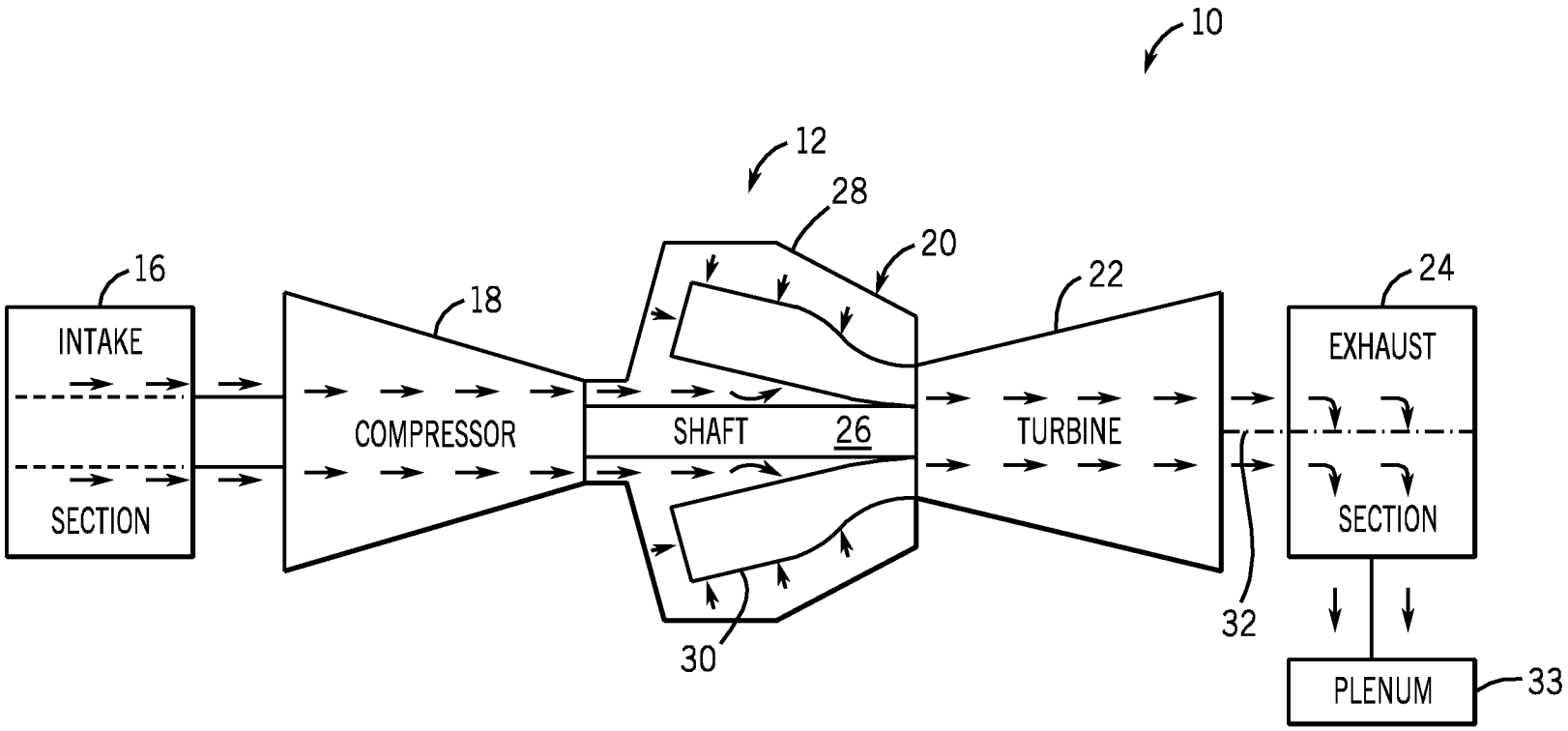
FIG. 1 is a schematic flow diagram of an embodiment of a gas turbine engine with an improved exhaust plenum.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The present disclosure is directed to a gas turbine engine that includes an exhaust system that provides improved pressure recovery and reduced backpressure and, therefore, increases the efficiency of the turbine engine. As exhaust gases exit the turbine through an axial-radial diffuser, the exhaust gases are guided through an exhaust duct that extends outward away from an axis of a shaft (e.g., in an approximately crosswise or radial direction). This change in the direction of exhaust flow (e.g., axial to radial) may tend to cause turbulence (e.g. swirling motion of the gases) and flow separation, which in turn causes significant backpressure. Additionally, as the combustion gases exit the turbine through the axial-radial diffuser, the gases typically enter a high volume exhaust plenum that causes a sudden expansion of the gases, which also causes increased turbulence inside the plenum and produces non-uniform gas flow in the plenum and other downstream components.

Embodiments of the present invention provide an exhaust plenum that provides a gradual three-dimensional expansion and more uniform flow of the exhaust gases within the plenum, thereby reducing backpressure, flow separation, and turbulence within the plenum. For example, the walls of the exhaust plenum diverge from one another in axial, radial, and circumferential directions. Additionally, the disclosed exhaust plenum has contoured walls to reduce losses in performance associated with the entry of the flow of exhaust gases into the plenum and the turning of the flow toward the exit of the exhaust plenum. For example, the contoured walls may gradually curve around, and diverge from, an outer circumference of turning vanes of the axial-radial diffuser. These contoured walls reduce low velocity regions and flow separation by eliminating sudden expansion regions in the flow direction. The disclosed exhaust plenum also may include one or more flow splitters that reduce losses associated with space constraints between the axial-radial diffuser and the bottom of the plenum. The overall result is reduced backpressure and increased flow uniformity in the exhaust system, as well as, increased gas turbine power and efficiency. Furthermore, the exhaust plenum described herein is more compact than typical exhaust plenums, and uses less material, which reduces costs and space consumption at a facility.

FIG. 1 is a schematic flow diagram illustrating an embodiment of a gas turbine engine 12 with an improved exhaust system. In certain embodiments, the system 10 may include an aircraft, a watercraft, a locomotive, a power generation system, or combinations thereof. The illustrated gas turbine engine 12 includes an air intake section 16, a compressor 18, a combustor section 20, a turbine 22, and an exhaust section 24. The turbine 22 is drivingly coupled to the compressor 18 via a shaft 26 oriented along a first longitudinal axis 32 of the turbine engine 12.

As indicated by the arrows, air may enter the gas turbine engine 12 through the intake section 16 and flow into the compressor 18, which compresses the air prior to entry into the combustor section 20. The illustrated combustor section 20 includes a combustor housing 28 disposed concentrically or annularly about the shaft 26 axially between the compressor 18 and the turbine 22. The compressed air from the compressor 18 enters combustors 30 where the compressed air may mix and combust with fuel within the combustors 30 to drive the turbine 22.

From the combustor section 20, the hot combustion gases flow through the turbine 22, driving the compressor 18 via the shaft 26. For example, the combustion gases may apply motive forces to turbine rotor blades within the turbine 22 to rotate the shaft 26. After flowing through the turbine 22, the hot combustion gases exit the gas turbine engine 12 through the exhaust section 24. As the combustion gases pass from the exhaust section 24 to an exhaust plenum 33, the plenum 33 guides the combustion gases at an angle away from the first longitudinal axis 32 of turbine engine 12 (e.g., approximately 90 degrees). In other words, the exhaust plenum 33 is oriented approximately crosswise or transverse to the longitudinal axis 32, e.g., a radial direction. For example, the illustrated turbine engine 12 includes a radial duct or plenum 33 to route the combustion gases through a 90 degree turn relative to the longitudinal axis 32. The change in direction (e.g., 90 degree turn) tends to induce turbulence and increase the backpressure on the turbine, thus decreasing the efficiency of the turbine. As will be explained in detail below, the plenum 33 includes various improvements that reduce the turbulence, flow separation, and backpressure. For example, the plenum 33 may include one or more diverging portions for expansion, flow splitters, and contoured or curved surfaces to reduce turbulence, flow separation, and backpressure.

Figure 2:
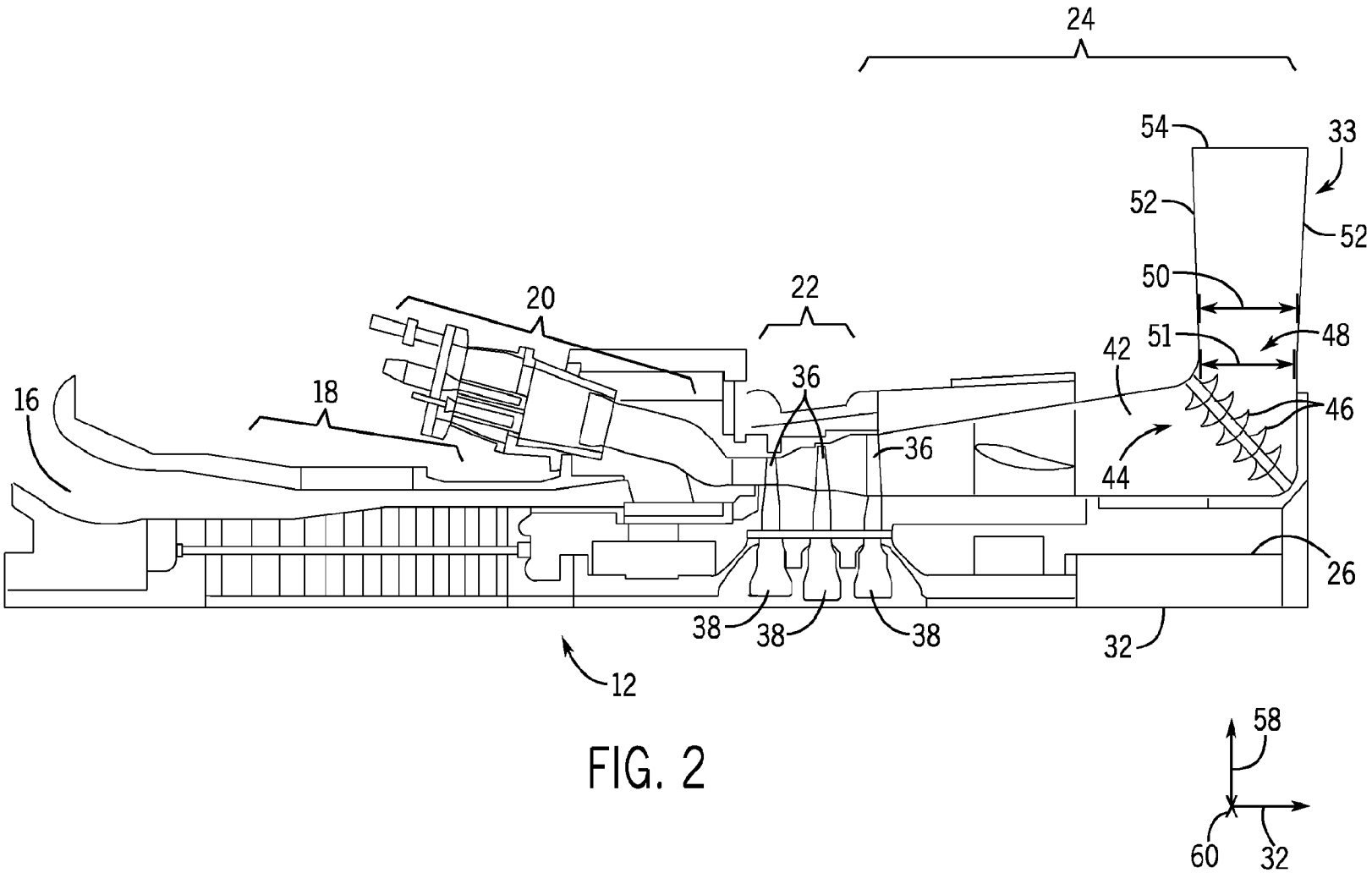
FIG. 2 is a cross-sectional side view of the gas turbine engine of FIG. 1 taken along a longitudinal axis illustrating an embodiment of the improved exhaust plenum.

FIG. 2 is a cross-sectional side view of the gas turbine engine 12 of FIG. 1, illustrating an embodiment of the improved exhaust plenum 33 of FIG. 1. As described above with respect to FIG. 1, air enters through the air intake section 16 and is compressed by the compressor 18. The compressed air from the compressor 18 flows into the combustor section 20 and mixes with fuel (e.g., liquid and/or gas fuel). The mixture of compressed air and fuel generally burns within the combustor section 20 to generate high-temperature, high-pressure combustion gases, which generate torque within the turbine 22. Specifically, the combustion gases apply motive forces to buckets (e.g., turbine blades) of rotor assemblies 36 to turn wheels 38 and the shaft 26. As is more clearly shown in FIG. 2, the exhaust section 24 includes an axial-radial diffuser section 42 disposed about the first longitudinal axis 32 downstream in an exhaust flow from the turbine section 22. The axial-radial diffuser section 42 guides the combustion gases annularly about the shaft 26 along the first longitudinal axis 32. The volume of the diffuser section 42 gradually increases toward a diffuser output 44, thereby gradually reducing the pressure and airflow speed within the diffuser section 42.

At the diffuser output 44, the combustion gases turn at approximately a 90 degree angle and flow into the plenum 33. The diffuser output 44 includes multiple radial guide vanes 46 (e.g., turning vanes) that guide the combustion gases through the 90 degree turn (e.g., axial to radial direction) into the plenum 33 and improve the flow uniformity through the diffuser output 44. The diffuser section 42 is disposed through an inlet 48 of the plenum 33, and the diffuser output 44 is fluidly coupled to the corresponding plenum inlet 48. As shown in FIG. 2, the initial width 50 of the plenum 33 at the plenum inlet 48 is similar to a width 51 of the diffuser output 44. Therefore, the combustion gases do not experience a sudden expansion and drop in pressure upon entering the plenum 33.

As discussed in detail below, the plenum 33 is configured to provide three-dimensional exhaust diffusion in radial, axial, and circumferential directions. The plenum 33 includes diverging walls in the radial, axial, and circumferential directions as well as contoured surfaces to reduce flow separation. For example, the combustion gases flow along aerodynamic surfaces, e.g., offset wall portions 52, inside the plenum 33. The wall portions 52 may be described as aerodynamic by virtue of their design with curvatures to reduce flow resistance, turbulence, flow separation, and back pressure. Further, these wall portions 52 diverge enabling the combustion gases to gradually expand within the plenum 33, thus gradually reducing the energy of the combustion gases. The plenum 33 also curves around the turning vanes 46 to gradually turn the flow of combustion gases radially away from the axis 32 of the gas turbine engine 12.

Figure 3:
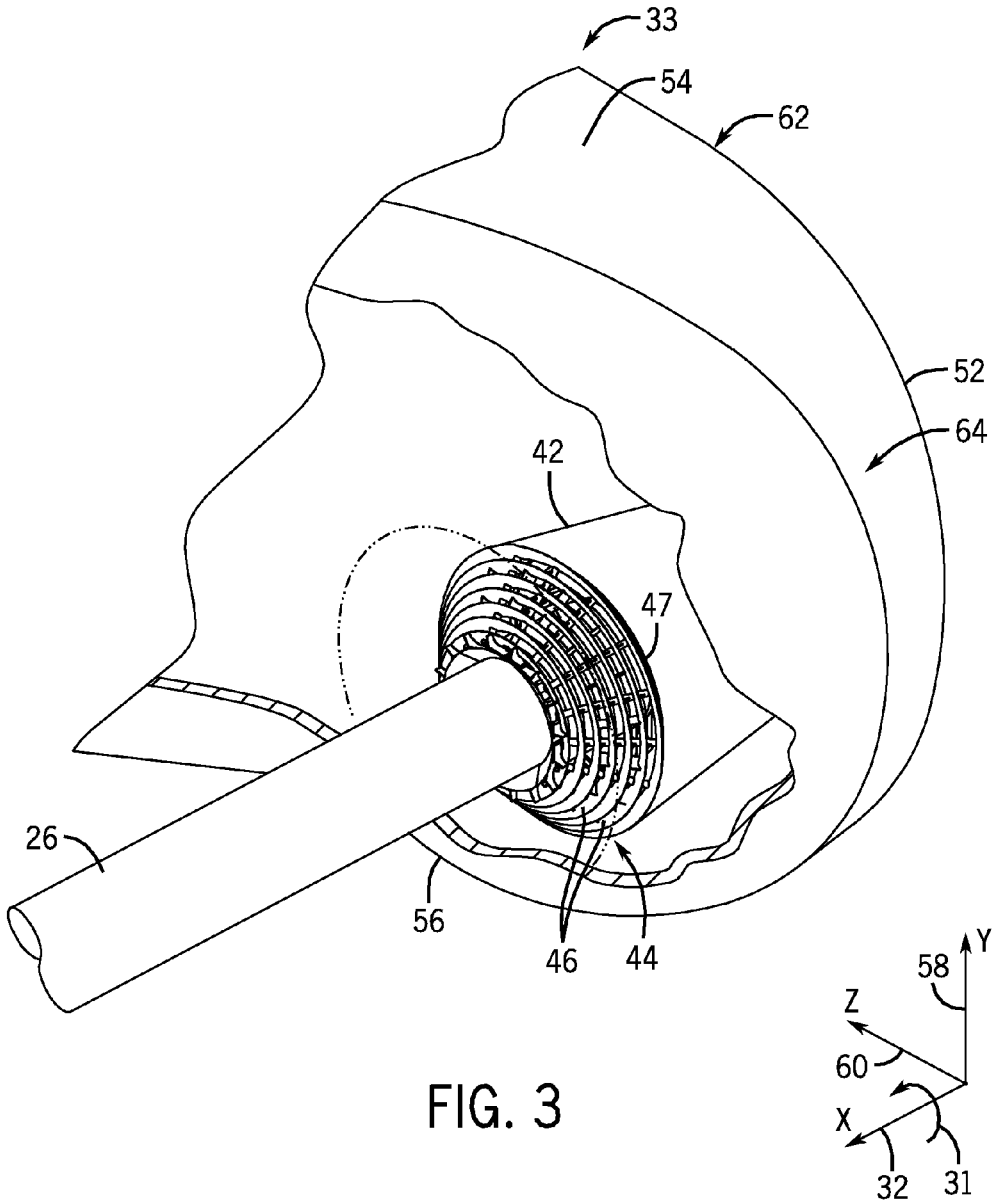
FIG. 3 is a cut-away perspective view of an embodiment of a portion of the exhaust plenum, as shown in FIG. 1, illustrating diverging wall portions.

FIG. 3 is a cut-away perspective view of an embodiment of the plenum 33 shown in FIG. 2. As discussed below, the plenum 33 provides three-dimensional expansion in axial, radial, and circumferential directions. For example, the plenum 33 expands along axes 32, 58, and 60, which are generally transverse (e.g., perpendicular) to one another. The plenum 33 also expands in a circumferential direction 31 relative to the turning vanes 46. As illustrated, the x-axis, indicated by direction 32, is the longitudinal axis of the gas turbine engine 12; the y-axis, shown by direction 58, is a longitudinal axis of the plenum 33; and the z-axis, shown by direction 60, is an approximately crosswise axis of the plenum 33. The axes 58 and 60 also may be described as radial axes relative to the longitudinal axis 32 of the gas turbine engine 12. Furthermore, the axis 32 may be described as an approximately crosswise axis of the plenum 33 similar to, but approximately crosswise from, the axis 58. In view of these axes or directions 31, 32, 58, and 60, the plenum 33 provides three-dimensional expansion in the axial direction 32, radial direction 58 and/or 60, and circumferential direction 31.

The plenum 33 includes a first plenum portion 62 disposed about the axial-radial diffuser section 42. As described above in reference to FIG. 2, the diffuser section 42 guides the combustion gases into the plenum 33 through the radial guide vanes 46. As is more clearly shown in FIG. 3, the radial guide vanes 46 may be circular (e.g., tapered annular or conical structures) and disposed concentrically about the first longitudinal axis 32. Accordingly, the combustion gases may exit the diffuser section 42 radially outward and away from the axis 32 of the shaft 26 about a circumference 47 of the annular diffuser output 44. For example, the first plenum portion 62 includes a curved wall portion 64 configured to gradually turn and diverge the exhaust flow from the circumference 47 in the circumferential direction 31 about the diffuser section 42. The curved wall portion 64 includes the wall portions 52 that diverge away from each other in both a first direction 58 and a second direction 60, as described below. The wall portions 52 gradually broaden the width of the flow path as the combustion gases travel away from the first longitudinal axis 32. As shown in FIG. 3, the bottom 56 of the plenum 33 may be closer to the diffuser output 44. Therefore, the diverging wall portions 52 may be nearer to each other toward the bottom 56 of the plenum 33. This off-center position of the diffuser output 44 along with the curved wall portion 64 provides circumferential expansion of the flow of combustion gases in the circumferential direction 31. The curved wall portion 64 and the diverging wall portions 52 reduce the turbulence, backpressure, and flow separation within the plenum 33, while providing a more uniform flow as the gases are guided through the plenum 33, as described below.

FIG. 4 is a cross-sectional side view of the plenum 33 illustrating the contoured structure. The plenum 33 includes the first plenum portion 62 and a second plenum portion 72. The first plenum portion 62 includes an axial-radial diffuser receptacle 74 having a first axis 32, representing the first longitudinal axis of the turbine engine 12, approximately crosswise to a second axis or the second longitudinal axis 60 extending lengthwise along the plenum 33. The axial-radial diffuser receptacle 74 is not centrally located in the first plenum portion 62, thus, the first axis 32 and the second axis 60 are offset from one another by an offset distance 76. The first plenum portion 62 includes the curved wall portion 64 disposed at a first longitudinal end 78 of the plenum 33 relative to the second axis 60. The curved wall portion 64 of the first plenum portion 62 diverges along a curved path 80 in a first direction 58 away from the first axis 32 toward the second axis 60, as well as, approximately crosswise to both the first axis 32 and the second axis 60. More specifically, the curved wall portion 64 diverges away from the first axis 32 from a first region 56 (e.g., adjacent the bottom 56) to the second region 54 (e.g., adjacent the top 54). In other words, a radial distance 79 between the curved wall portion 64 and a circumference 81 of the receptacle 74 (e.g., circumference 47 of diffuser section 42) gradually increases along the curved path 80, which corresponds to the circumferential direction 31 about the longitudinal axis 32. Thus, the hot combustion gases follow the curved path 80 to undergo circumferential expansion in the circumferential direction 31 and radial expansion in the radial direction 58. In some embodiments, a flow splitter 82 may extend between the axial-radial diffuser receptacle 74 and the first region 56 of the first plenum portion 62 of the plenum 33. The flow splitter 82 may guide the flow of the combustion gases away from the bottom or first region 56, e.g., along the curved path 80. Thus, the flow splitter 82 may prevent flow reversal that may occur between the first region 56 and the diffuser output 44 due to space constraints between the diffuser 44 output and the first region 56.

Flow of the combustion gases is directed from the first plenum portion 62 toward the second plenum portion 70. The second plenum portion 70 extends away from the first plenum portion 62 downstream along the second axis 60 approximately crosswise to the first axis 32. The contoured or curved shape of the first plenum portion 62 helps guide the diffusion of the combustion gases from the first plenum portion 62 towards the second plenum portion 70 without the turning and entry losses associated with a rectilinear geometry, as described in more detail in FIG. 5.

FIG. 5 is a partial cross-sectional side view of the plenum 33 taken within line 5-5 of FIG. 4 illustrating the flow of the combustion gases within the plenum 33 from the axial-radial diffuser section 42. The plenum 33 includes the first plenum portion 62 and the second plenum portion 70, as described above. The first plenum portion 62 is disposed about the axial-radial diffuser section 42. Combustion gases diffuse radially, as indicated by arrows 90, across a circumference 92 of the axial-radial diffuser section 42. For example, the radial diffusion 90 may extend in radial direction 58 across the plenum 33 and radial direction 60 along the plenum, or any angle there between. As illustrated, some of the radial diffusion 90 is directed upstream 89 relative to a midplane 91 through the axis 32 of the diffuser section 42, whereas some of the radial diffusion 90 is directed downstream 93 relative to the midplane 91. The flow splitter 82 is disposed generally along the bottom 56 of the plenum 33 at the midplane 91, thereby separating the upstream 89 and downstream 93 flows. In other words, the flow splitter 82 blocks the downstream 93 flow from reversing to the upstream 89 flow direction. On the downstream 93 side, the combustion gases flow along the axis 60 in a downstream flow path 95. On the upstream 89 side, the combustion gases flow along the curved path 80 between the curved path 80 between the curved wall portion 64 and the circumference 92 of the diffuser section 42 to undergo a gradual turn of approximately 0 to 180 degrees.

The curved wall portion 64 and the circumference 92 define opposite curved boundaries of the curved path 80. The curved path 80 begins at the flow splitter 82 and extends to the top 54 across the midplane 91. Thus, the illustrated curved path 80 extends over a turn of approximately 180 degrees to gradually redirect the hot combustion gases to the downstream flow path 95. In addition, the curved wall portion 64 diverges from the circumference 92 of the axial-radial diffuser section 42 along curved path 80 at least partially around the circumference 92 generally in the first direction 58 and/or circumferential direction 31. More specifically, the first plenum portion 62 includes a first distance 94 between the circumference 92 of the diffuser section 42 and the first region 56 of the curved wall portion 64. Following the curved path 80 generally in the first direction 58 and/or circumferential direction 31, the gap between the curved wall portion 64 and the circumference 92 of the diffuser section 42 increases to a second distance 96 greater than the first distance 94. Further along the same curved path 80 towards the second region 54, the gap between the curved wall portion 64 increases to a third distance 98 greater than the second distance 98. Thus, the curved wall portion 64 diverges away from the circumference 92 of the axial-radial diffuser section 42 between the first region 56 and the second region 54, thereby circumferentially expanding while turning the flow of combustion gases that radially exit the diffuser section 42. Further, the contour of the curved wall portion 64 minimizes the losses normally associated with a more rectilinear structure when guiding the flow. In other words, the curved boundaries of the curved wall portion 64 and the circumference 92 provide a gradual expansion (e.g., 94, 96, 98) without any abrupt changes.

Figure 6:
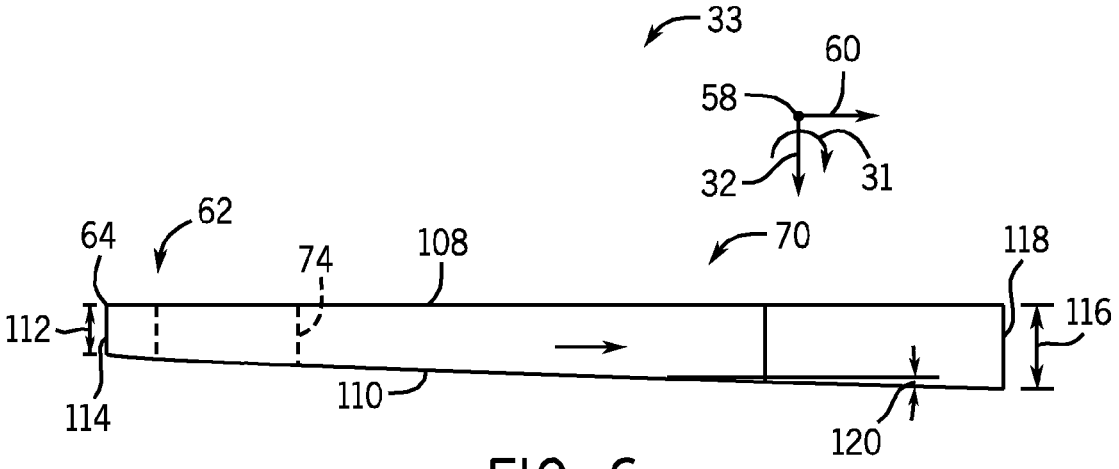
FIG. 6 is a top view of the exhaust plenum in FIG. 4.

In addition to the curved path 80 with gradual expansion, the plenum 33 provides expansion in other directions to allow for the gradual diffusion of the gases throughout the plenum 33. FIG. 6 illustrates a top view of an embodiment of the plenum 33 taken from the perspective of line 6-6 of FIG. 4, illustrating expansion of the first plenum portion 62 and the second plenum portion 70 along axis 60. Dashed lines indicate the position of the axial-radial diffuser receptacle 74 within the first plenum portion 62. The plenum 33 gradually expands along the longitudinal axis 60 with a first width 112 located at a first end 114 of the first plenum portion 62 and a second width 116 located at a second end 118 of the second plenum portion 70. The first width 112 is less than the second width 116. The ratio of the second width 116 to the first width 112 may range between approximately 3 to 1, 2 to 1, or 1.5 to 1.By further example, the ratio may be approximately 2, 1.9, 1.8, 1.7, 1.6, 1.5, or 1.4.In certain embodiments, the first width 112 may be less than second width 116 by approximately 50, 45, 40, 35, 30, or 25 percent. However, the ratio may vary between different implementations of the plenum 33.

Both the first plenum portion 62 and the second plenum portion 70 include a first wall portion 108 and a second wall portion 110 extending along both plenum portions 62 and 70 in direction 60. The first and second wall portions 108 and 110 are offset from another in direction 32 along the longitudinal axis 32 of the axial-radial diffuser receptacle 74. As shown in FIG. 6, the first and second wall portions 108 and 110 generally diverge from one another from the first end 114 to the second end 118. In the illustrated embodiment, the first and second wall portions 108 and 110 include or represent diverging flat wall portions. However, some embodiments of the wall portions 108 and 110 may include diverging curved wall portions in the direction 60. The second wall portion 110 diverges from the first wall portion 108 along the longitudinal axis 60 of the plenum 33 at an angle 120 relative to the first wall portion 108, wherein the first wall portion 108 is parallel to the axis 60. In certain embodiments, the angle 120 may range between approximately 4 to 0.5 degrees, 3 to 1 degrees, or 2 to 1.5 degrees. For example, the angle 120 may be approximately 2.3, 2.2, 2.1, 2.0, 1.9, 1.8, or 1.7 degrees, or any angle there between. In some embodiments, the angle 120 is constant. In other embodiments, the angle 120 may vary along the length of the second wall portion 110. The angle 120 allows the first and second wall portions 108 and 110 to diverge along the longitudinal axis of the plenum 33 in direction 60 in the first and second plenum portions 62 and 70. In some embodiments, the first wall portion 108 may diverge from the second wall portion 110 along the longitudinal axis 60 of the plenum 33 at an angle relative to the second wall portion 110, wherein the second wall portion 110 is parallel to the axis 60. The gradual expansion from the first plenum portion 62 to second plenum portion 70 increases the performance of the plenum 33 by allowing more gradual systematic diffusion and providing a more uniform flow. Also, having the second wall portion 108 at angle 120 reduces the amount of materials necessary for the plenum 33 in the first plenum portion 62.

Figure 7:
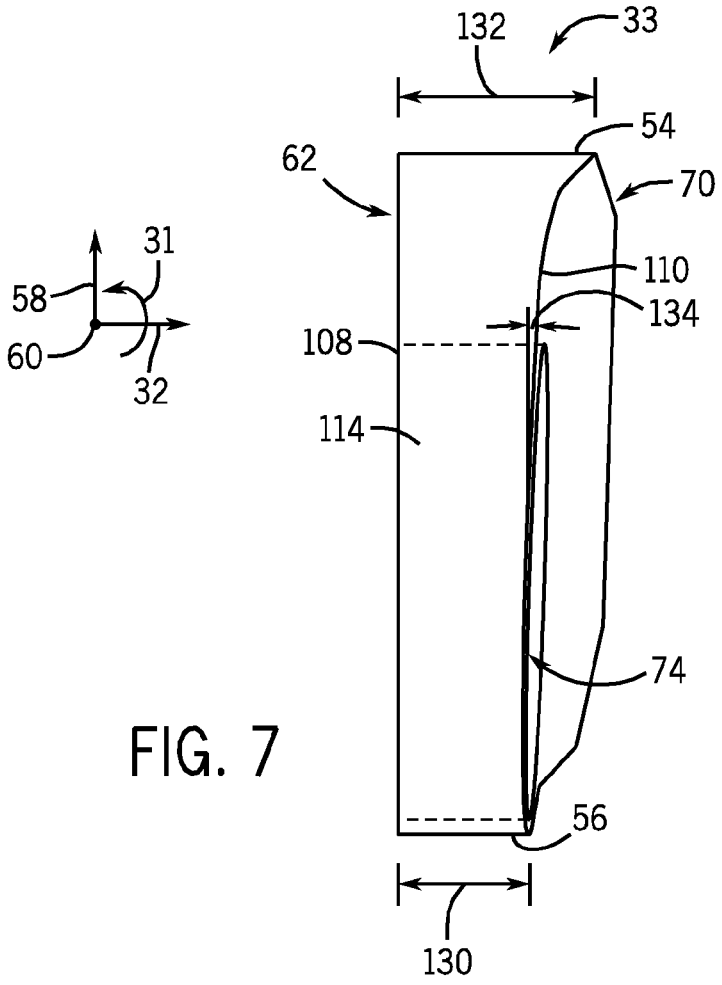
FIG. 7 is an end view of the exhaust plenum in FIG. 4.

FIG. 7 is an end view of an embodiment of the plenum 33 taken from the perspective of line 7-7 of FIG. 4, illustrating expansion of the first and second plenum portions 62 and 70 along the axis 58. The plenum 33 includes the first plenum portion 62, the second plenum portion 70, and the axial-radial diffuser receptacle 74 disposed in the first plenum portion 62. As illustrated in FIG. 7, the plenum 33 gradually expands in direction 58 with a lower width 130 near the first region 56 and an upper width 132 near the second region 54. The lower width 130 is less than the upper width 132. The ratio of the upper width 132 to the lower width 130 may range between approximately 3 to 1, 2 to 1, or 1.5 to 1.By further example, the ratio may be approximately 2, 1.9, 1.8, 1.7, 1.6, 1.5, or 1.4.In certain embodiments, the lower width 130 may be less than the upper width 132 by approximately 50, 45, 40, 35, 30, or 25 percent.

As discussed above, the first and second plenum portions 62 and 70 include first and second wall portions 108 and 110 offset from another in direction 32 along the longitudinal axis of the axial-radial diffuser receptacle 74. In the illustrated embodiment, the first and second wall portions 108 and 110 include or represent diverging flat wall portions. However, some embodiments of the wall portions 108 and 110 may include diverging curved wall portions in the direction 58. The second wall portion 110 diverges from the first wall portion 108 at an angle 134 relative to direction 58 of the plenum 33. In certain embodiments, the angle 134 may range between approximately 4 to 0.5 degrees, 3 to 1 degrees, or 2 to 1.5 degrees. For example, the angle 134 may be approximately 1.3, 1.2, 1.1, 1.0, 0.9, 0.8, or 0.7 degrees, or any angle there between. In certain embodiments, angle 134 may be the same as angle 120. This angle 134 also reduces the amount of materials necessary for the plenum 33 in the first plenum portion 62. In some embodiments, the angle 120 is constant. In other embodiments, the angle 120 may vary along the length of the second wall portion 110. The angle 134 allows the first and second wall portions 108 and 110 of the plenum 33 to diverge in first direction 58 in at least the first plenum portion 62. In some embodiments, the first and second wall portions 108 and 110 diverge in direction 58 in both the first plenum portion 62 and the second plenum portion 70. In some embodiments, the first and second wall portions 108 and 110 may diverge from one another in both directions 58 and 60, as illustrated in FIGS. 6 and 7. For example, the wall portions 108 and 110 may diverge from the bottom 56 to the top 54 and from the first end 112 to the second end 118 in both plenum portions 62 and 70. The divergence in both the first direction 58 and the second direction 60 allows for the gradual systematic diffusion of the flow of gases from the first plenum portion 62 towards the second plenum portion 70, thus reducing the turbulence, flow separation, and back pressure.

Technical effects of the disclosed embodiments include three-dimensional diffusion in a plenum 33 with gradual divergence between flow boundaries in axial, radial, and circumferential directions. For example, the plenum 33 substantially reduces or eliminates regions of abrupt expansion in the axial, radial, and circumferential directions to reduce turbulence, flow separation, and backpressure. As discussed above, the plenum 33 includes the curved wall portion 64 to reduce the entry losses where the combustion gases enter the plenum 33 from the axial-radial diffuser section 42 and, as well, the turning losses associated with directing the flow towards the exit of the plenum 33. For example, the curved wall portion 64 helps guide the flow of combustion gases along the curved path 80 in the circumferential direction 31 while also gradually expanding the combustion gases. The plenum 33 also includes wall portions 108 and 110 that diverge in the first direction 58 (e.g., approximately crosswise) and in the second direction 60 (e.g., lengthwise) along the axis 32 of the plenum 33 to allow for gradual systematic diffusion throughout the plenum 33. Further, the flow splitter 82 helps direct and guide the flow that exits near the first section 56 of the first plenum portion 62 to prevent flow reversal due to space constraints between the first section 56 and the axial-radial diffuser section 42. Overall, these features improve the overall performance of the plenum 33.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system, comprising:

a turbine exhaust plenum, comprising:

a first plenum portion comprising an axial-radial diffuser receptacle having a first axis approximately crosswise to a second axis extending lengthwise along the turbine exhaust plenum, wherein the first plenum portion comprises a curved wall portion that diverges away from the first axis along a curved path in a first direction approximately crosswise to the first and second axes, the first plenum portion comprises first and second wall portions offset from one another along the first axis, the first and second wall portions diverge from one another in the first direction, and the first and second axes are offset from one another by an offset distance; and a second plenum portion extending away from the first plenum portion downstream along the second axis of the exhaust plenum, wherein the first and second wall portions extend along the second plenum portion, the first and second wall portions diverge from one another in a second direction along the second axis toward the second plenum portion in both the first and second plenum portions, and the first wall portion extends parallel to the second axis in both the first and second directions in both the first and second plenum portions.

2. The system of claim 1, wherein the first and second wall portions comprise diverging flat wall portions.

3. The system of claim 1, wherein the curved wall portion diverges away from the first axis from a first region to a second region, and a flow splitter extends between the axial-radial diffuser receptacle and the exhaust plenum in the first region, the flow splitter being aligned with a center point of the axial-radial diffuser receptacle along a midplane through the axial-radial diffuser receptacle that extends through the first and second axes.

4. The system of claim 1, wherein the curved wall portion diverges away from the first axis in the first direction from the first axis toward the second axis.

5. The system of claim 1, wherein the first and second wall portions diverge from one another in the first direction in both the first and second plenum portions at an approximately 1 degree angle, and the first and second wall portions diverge in the second direction in both the first and second plenum portions at an approximately 2 degree angle.

6. A system, comprising:

a turbine exhaust plenum, comprising:

a first plenum portion comprising an axial-radial diffuser receptacle having a first axis approximately crosswise to a second axis extending lengthwise along the turbine exhaust plenum, wherein the first plenum portion comprises a curved wall portion that diverges away from the first axis along a curved path in a first direction approximately crosswise to the first and second axes, the first and second axes are offset from one another by an offset distance, and the curved wall portion diverges away from the first axis in the first direction from the first axis toward the second axis; and a second plenum portion extending away from the first plenum portion in a second direction along the second axis of the exhaust plenum, wherein the second plenum portion comprises first and second wall portions offset from one another, and the first wall portion extends parallel to the second axis in both the first and second directions, while the second wall portion diverges from the first wall portion in both the first and second directions.

7. The system of claim 6, wherein the first and second wall portions are offset from one another in a third direction along the first axis.

8. The system of claim 7, wherein the second wall portion diverges from the first wall portion at an approximately 1 degree angle in the first direction and at an approximately 2 degree angle in the second direction.

9. A system, comprising:

a turbine exhaust plenum, comprising:

a first plenum portion comprising an axial-radial diffuser receptacle having a first axis approximately crosswise to a second axis extending lengthwise along the turbine exhaust plenum, wherein the first plenum portion comprises a curved wall portion that diverges away from the first axis along a curved path in a first direction approximately crosswise to the first and second axes, the first plenum portion comprises first and second wall portions offset from one another along the first axis, and the first and second wall portions diverge from one another in the first direction; and a second plenum portion extending away from the first plenum portion downstream along the second axis of the exhaust plenum, and wherein the first and second wall portions diverge in a second direction along the second axis toward the second plenum portion, the first and second wall portions extend along the second plenum portion, the first and second wall portions diverge from one another in the first direction in both the first and second plenum portions at an approximately 1 degree angle, and the first and second wall portions diverge in the second direction in both the first and second plenum portions at an approximately 2 degree angle.

* * * * *